United States Patent [19]

Yolton et al.

[11] Patent Number: 4,999,051

[45] Date of Patent: Mar. 12, 1991

[54] SYSTEM AND METHOD FOR ATOMIZING A TITANIUM-BASED MATERIAL

[75] Inventors: Charles F. Yolton, Caraopolis; Thomas Lizzi, Zelienople; John H. Moll, Pittsburgh, all of Pa.

[73] Assignee: Crucible Materials Corporation, Pittsburgh, Pa.

[21] Appl. No.: 413,177

[22] Filed: Sep. 27, 1989

[51] Int. Cl.[5] ..... B22D 23/08

[52] U.S. Cl. ..... 75/338; 264/12; 264/13; 266/236

[58] Field of Search ..... 222/608; 266/137, 202, 266/217, 236, 242, 266, 275; 425/7

[56] References Cited

U.S. PATENT DOCUMENTS 4,544,404 10/1985 Yolton et al. ..... 264/12

OTHER PUBLICATIONS

Production and Characterization of Rapidly Solidified Titanium and Other Alloy Powders Mae by Gas Atomization, John Moll and C. F. Yolton, pp. 45-46, 1986.

Evaluation of Ti-10V-2Fe-3Al and Ti-10V-2Fe-3Al-+Er Powder Produced by Atomization, P.T. Smith et al., 7/87 ASM Symposium, pp. 1-11.

Review and Status of Titanium Materials Produced From Spherical Prealloyed Powder, J. H. Moll & C. F. Yolton, Crucible Materials Corp. pp. 1-18.

Gas Atomized Titanium Powder, C. F. Yolton & J. H. Moll, Metals/Materials Technology Series, 2/86, pp. 97-100.

*Primary Examiner*—Olik Chaudhuri

*Assistant Examiner*—Felisa Garrett-Meza

*Attorney, Agent, or Firm*—Finnegan, Henderson, Farabow, Garrett & Dunner

[57] ABSTRACT

A system and method for atomizing a titanium-based material to particulates in a controlled atmosphere. The system includes a crucible for skull melting a titanium-based material. The molten titanium-based material is transferred to a tundish for receiving the molten titanium-based material. The tundish has a bottom portion with an aperture formed therein and is heated. A molten metal nozzle for forming the molten titanium-based material into a free-falling stream exiting from the tundish is provided, the molten metal nozzle being coaxially aligned with the aperture of the tundish. A baffle may be disposed in the tundish for stabilizing the free-falling stream of the molten titanium-based material. The molten titanium-based material is atomized by impinging the free-falling stream of the molten titanium-based material with an inert gas jet issuing from a gas nozzle. The system also includes a device for cooling the atomized titanium-based material, and a device for collecting the cooled atomized titanium-based material. In the method, titanium is skull melted in a crucible. The molten titanium-based material is transferred to a heated tundish. The molten titanium-based material may be stabilized in the heated tundish and then formed into a free-falling stream. The free-falling stream of the molten titanium-based material is impinged with an inert gas jet to atomize the molten titanium-based material. The method also includes cooling the atomized titanium-based material, and collecting the cooled atomized titanium-based material.

33 Claims, 4 Drawing Sheets

SYSTEM AND METHOD FOR ATOMIZING A TITANIUM-BASED MATERIAL

FIELD OF THE INVENTION

The present invention relates to powder metallurgy and, more particularly, to a system and method for atomizing a titanium-based material.

BACKGROUND OF THE INVENTION

Yelton et al. U.S. Pat. No. 4,544,404, which is assigned to the assignee of the subject application, discloses a method of atomizing a titanium-based material. In this method, titanium is arc melted in a water-cooled copper crucible provided with a rupture disc. A layer or skull of solidified titanium forms adjacent to the interior of the water-cooled crucible. This skull prevents the molten titanium-based material, which is highly reactive, from being contaminated by the interior of the crucible. To pour the molten titanium-based material from the crucible, the electrode is moved closer to the pool of molten titanium-based material so as to melt through the skull and the rupture disc. The molten titanium-based material flows into a tundish provided at the bottom of the crucible. The tundish has an opening in which a nozzle having a refractory metal interior is disposed. The molten titanium-based material forms a free-falling stream as it flows through the nozzle. The free-falling stream of molten titanium-based material is atomized by an inert gas jet issuing from an annular orifice. The atomized titanium particles are collected in a canister disposed at the base of the cooling chamber.

It is an object of the present invention to provide a system and method for atomizing a titanium-based material that is capable of producing larger quantities of titanium powder.

Additional objects and advantages will be set forth in part in the description which follows and, in part, will be obvious from the description, or may be learned by practice of the invention.

SUMMARY OF THE INVENTION

To achieve the foregoing object and in accordance with the purpose of the invention, as embodied and broadly described herein, the system for atomizing a titanium-based material to particulates in a controlled atmosphere of this invention includes crucible means for skull melting the titanium-based material. The molten titanium-based material is transferred from the crucible means to tundish means for receiving the molten titanium-based material. The tundish means has a bottom portion with an aperture formed therein and is provided with a means for heating it. Molten metal nozzle means for forming the molten titanium-based material into a free-falling stream exiting from the tundish means are provided, the molten metal nozzle means being coaxially aligned with the aperture of the tundish means. In a preferred embodiment, baffle means are disposed in the tundish means for stabilizing the free-falling stream of the molten titanium-based material. The molten titanium-based material is atomized to particulates by impinging the free-falling stream of molten titanium-based material with an inert gas jet issuing from gas nozzle means. The system also includes means for cooling the atomized titanium-based material, and means for collecting the cooled atomized titanium-based material.

According to the method for atomizing a titanium-based material to particulates in a controlled atmosphere of this invention, a titanium-based material is skull melted in a crucible. The molten titanium-based material is transferred to a heated tundish. In a preferred embodiment, the molten titanium-based material is stabilized in the heated tundish and formed into a free-falling stream as it leaves the heated tundish. The free-falling stream of the molten titanium-based material is impinged with an inert gas jet to atomize the molten titanium-based material to particulates. The method also includes cooling the atomized titanium-based material, and collecting the cooled atomized titanium-based material.

BRIEF DESCRIPTION OF THE DRAWINGS

The accompanying drawings, which are incorporated in and constitute a part of this specification, illustrate several embodiments of the invention and, together with the description, serve to explain the principles of the invention.

DESCRIPTION OF THE PREFERRED EMBODIMENTS

Reference will now be made in detail to the present preferred embodiments of the invention, examples of which are illustrated in the accompanying drawings.

Figure 1:
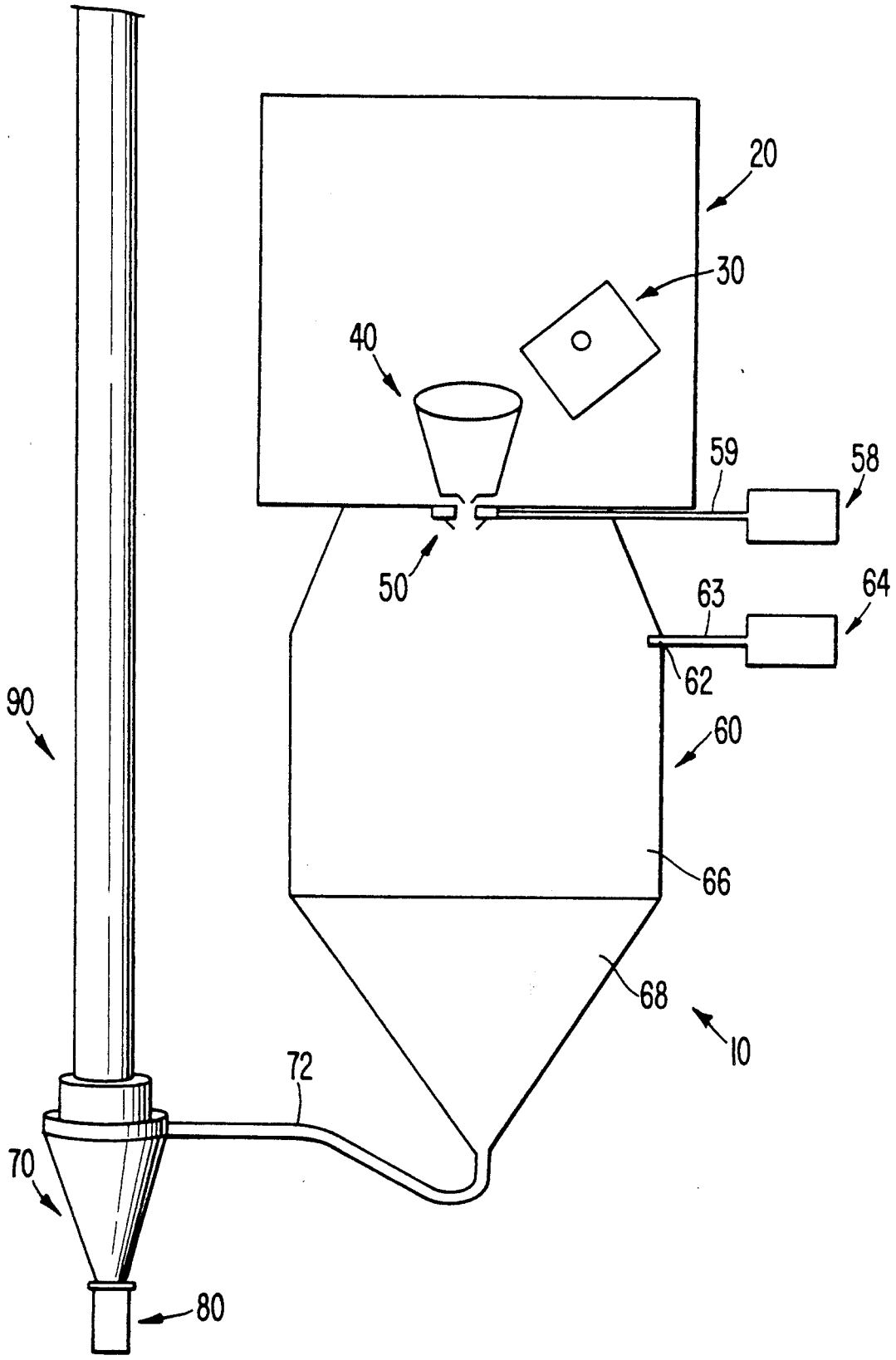
FIG. 1 is a schematic diagram of one embodiment of the system of the invention.

The present invention is a system and method for atomizing a titanium-based material (hereinafter referred to as "titanium" for the sake of brevity). FIG. 1 is a schematic diagram of a preferred embodiment of the system in which the system is generally shown as 10.

In accordance with the invention, the system for atomizing titanium includes crucible means for skull melting titanium. As embodied herein, and with reference to FIG. 1, the crucible means includes water-cooled, segmented copper crucible 30. A crucible of this type is disclosed in U.S. Pat. No. 4,738,713, which is assigned to The Duriron Company, Inc. Crucible 30 is surrounded by an induction coil (not shown) and disposed in vacuum/inert gas furnace chamber 20 because titanium must be melted in a controlled atmosphere of inert gas or under vacuum. Crucible 30 is preferably rotatably disposed in chamber 20 so that it can be tilted to pour molten titanium from its lip.

The titanium charge to be melted is loaded directly into crucible 30 and an electromagnetic induction field is applied to melt the titanium. It has been found to be beneficial to double melt the charge prior to atomization: melting first under vacuum and then in an argon atmosphere. When vacuum melting is employed, it is necessary to back fill furnace chamber 20 with an inert gas, such as argon, prior to atomization. As the molten pool of titanium forms, it is vigorously stirred and homogenized by the electromagnetic induction field. When the molten titanium-based material comes in contact with the water-cooled copper walls of crucible 30, the titanium solidifies or "freezes" to form a skull which separates the molten pool of titanium from crucible 30. When the titanium charge is molten, the molten titanium may be lip poured by tilting crucible 30. During lip pouring, a spout of solidified titanium is formed as the molten titanium is poured over the lip of crucible 30.

Figure 2:
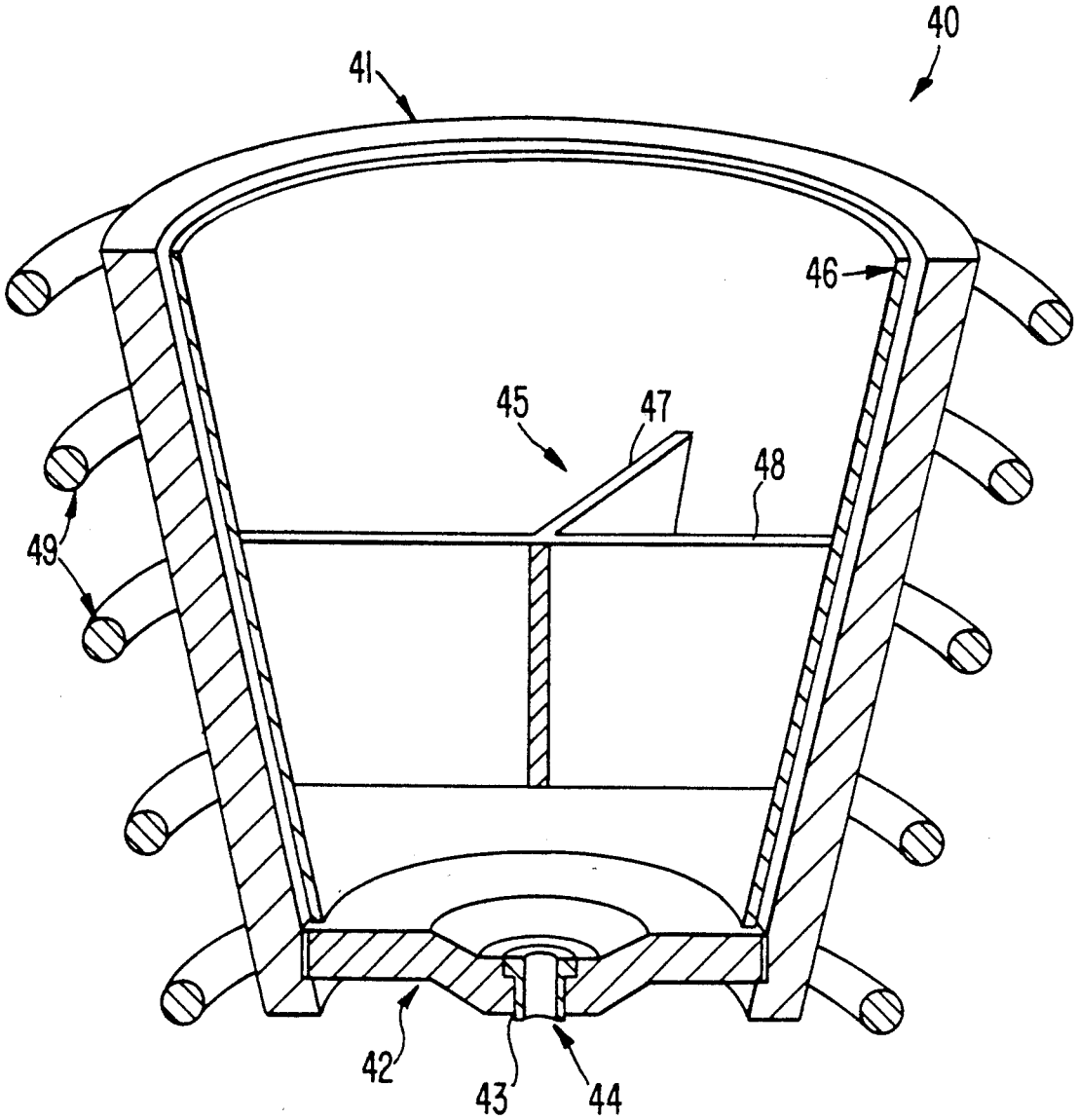
FIG. 2 is a cross sectional view of the tundish means, the means for heating the tundish means, the baffle means, and the molten metal nozzle means of one embodiment of the system of the invention.

In accordance with the invention, the system includes tundish means for receiving molten titanium. The tundish means has a bottom portion with an aperture formed therein. The tundish means is provided as an intermediate channeling vessel to stabilize and control the flow of molten titanium poured from the lip of the crucible means. As embodied herein, and with reference to FIGS. 1 and 2, the tundish means includes tundish 40 comprised of top portion 41 and nozzle plate portion 42. Top portion 41 preferably has a generally frustoconical configuration. Nozzle plate portion 42 is generally circular and is disposed at the narrower, bottom end of top portion 41. Nozzle plate portion 42 has aperture 43 formed therein, which also is generally circular. The region of nozzle plate portion 42 surrounding aperture 43 is configured to accept a nozzle means which will be described in detail below. Top portion 41 and nozzle plate portion 42 are preferably comprised of graphite because it has favorable heat resistance properties, it is relatively non-reactive with molten titanium, it has adequate high temperature mechanical strength and toughness properties, and it also has a thermal expansion coefficient equal to or less than titanium and many of its alloys.

The two-piece configuration of tundish 40 is preferred because it facilitates the removal of the titanium skull and provides for greater reusability of the tundish. After a heat, solidified metal is often found to have flared out at the bottom of nozzle plate portion 42 making it extremely difficult to remove the skull without damaging the nozzle area of the tundish. This problem is alleviated because nozzle plate portion 42 may be removed from tundish 40 along with the titanium skull. If nozzle plate 42 is severely damaged, then only that portion of tundish 40 must be replaced.

In a preferred embodiment, top portion 41 of tundish 40 has a removable liner 46 disposed about its inner surface. The removable liner 46 preferably consists essentially of commercially pure titanium. Commercially pure titanium is compatible with molten titanium so that contamination of the melt is not a problem. Furthermore, the melting point of commercially pure titanium is above that of most titanium alloys and it has sufficient thermoconductivity to permit a skull to form on it before it begins to dissolve. The use of a removable liner consisting essentially of commercially pure titanium minimizes the possibility that the skull will bond to a graphite tundish. When such bonding occurs, gouges are formed in cone section 41 of crucible 40 during removal of the skull. Such gouges render the tundish unusable for direct, i.e., linerless, pouring because the skull forms in the gouges and cannot be removed without destroying top section 41. By disposing a commercially pure titanium liner in such a gouge-damaged cone section, the service life of a graphite tundish may be extended.

In accordance with the invention, the system includes means for heating the tundish means. As embodied herein, and with reference to FIG. 2, the means for heating the tundish 40 includes induction coil 49 and a suitable power source (not shown). The tundish means should be heated to a temperature at which solidification of the molten titanium at the molten metal nozzle means (to be described in detail below) is prevented but at which formation of a skull occurs so that the molten titanium does not react with the tundish means. It has been found that heating the tundish means to a temperature greater than approximately 1000° F. is sufficient for this purpose.

In accordance with the invention, the system includes molten metal nozzle means for forming molten titanium into a free-falling stream exiting from the tundish means. In connection with the description of the invention, the term "free-falling stream" includes a stream exiting from a pressurized chamber. As embodied herein, and with reference to FIG. 2, the molten metal nozzle means is comprised of molten metal nozzle 44. Molten metal nozzle 44 is disposed within aperture 43 so that it is coaxially aligned with aperture 43. Molten metal nozzle 44 is preferably comprised of a refractory metal such as tantalum, molybdenum, tungsten, rhenium, or an alloy of such refractory metals. In a preferred embodiment, molten metal nozzle 44 has a cylindrical configuration resembling that of a flat washer and has an inside diameter substantially equal to or less than the inside diameter of aperture 43. The size of molten metal nozzle 44 may be varied to obtain the desired flow rate of molten titanium exiting the tundish means.

In a preferred embodiment, the system includes baffle means disposed in the tundish means for stabilizing the free-falling stream of molten titanium. The function of the baffle means is to dissipate the kinetic energy which the molten titanium gains on pouring from the crucible means and to eliminate swirling of the molten titanium as the tundish means is being emptied. Both of these effects contribute to stabilizing the free-falling stream of molten titanium delivered from the bottom of the tundish. As embodied herein, and with reference to FIG. 2, baffle 45 is comprised of intersecting plates 47 and 48. Plates 47 and 48 are dimensioned such that the outer ends thereof abut the inner surface of removable liner 46 to hold baffle 45 above the bottom portion of tundish 40. Similar to removable liner 46, plates 47 and 48 also preferably consist essentially of commercially pure titanium.

Those skilled in the art will recognize that the design of the baffle means may be varied. For example, the baffle means may include more than two intersecting plates. Conversely, it is not necessary that the baffle means include intersecting plates. A single plate dimensioned such that its outer ends abut the inner surface of the removable liner also yields satisfactory results.

Figure 3:
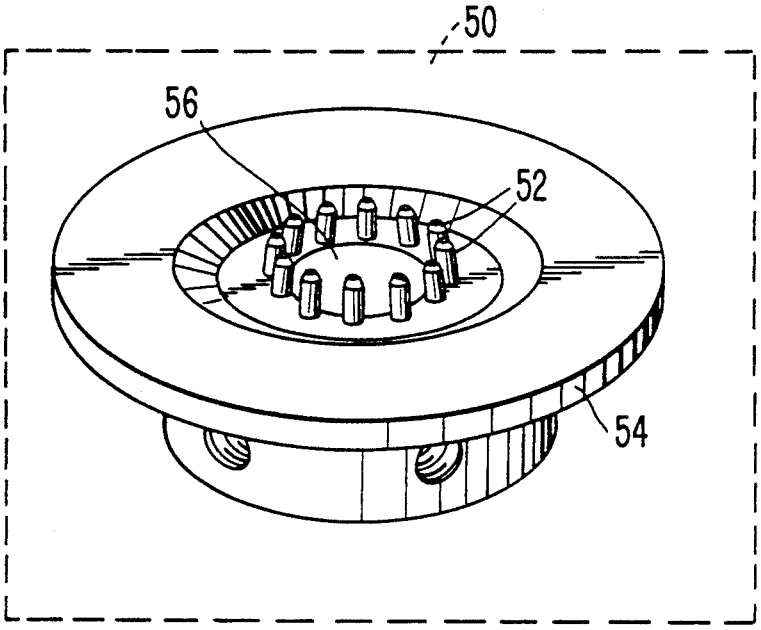
FIG. 3 is a perspective view of the gas nozzle means of one embodiment of the system of the invention.
Figure 4:
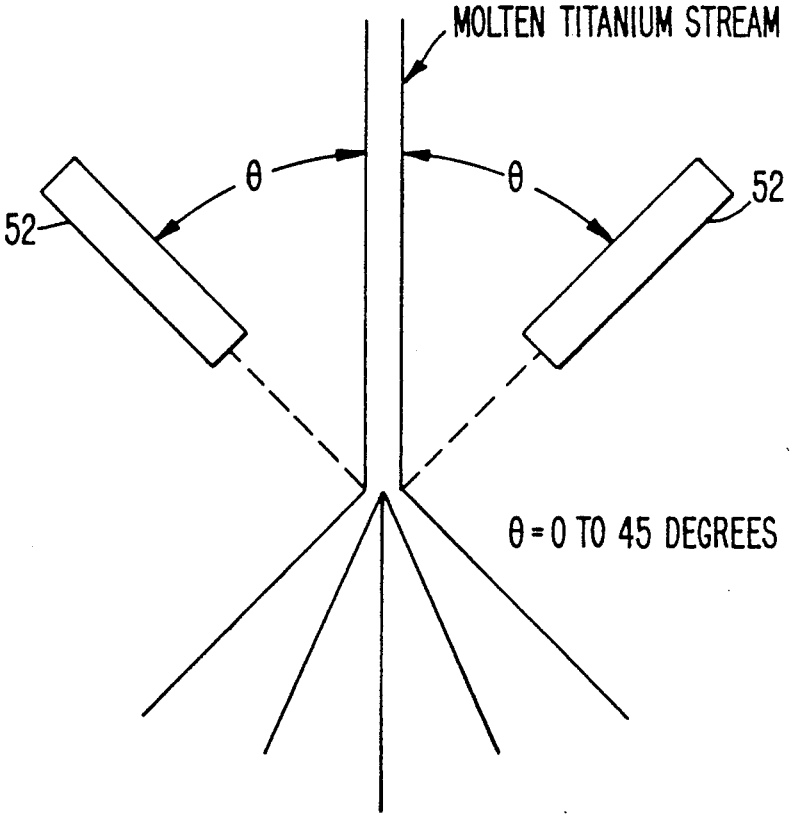
FIG. 4 is a schematic diagram of the relationship between the free-falling stream of molten titanium and the gas nozzles in, one embodiment of the system of the invention.

In accordance with the invention, the system includes gas nozzle means for impinging the free-falling stream of molten titanium with an inert gas jet to atomize the molten titanium to particulates. As embodied herein, and with reference to FIG. 3, the gas nozzle means shown generally as 50 includes a plurality of discrete gas nozzles 52 symmetrically disposed on annular ring 54 about central opening 56. The opening 56 in ring 54 is circular and has a diameter great enough to permit the free-falling molten titanium stream exiting from the tundish means to pass therethrough. Gas nozzles 52 may be inclined towards the principal flow axis of the molten titanium stream at an included angle between 0 and 45 degrees. FIG. 4 is a schematic diagram of the relationship between the free-falling stream of molten titanium and the gas nozzles in one embodiment of the system of the invention. As can be seen in FIG. 4, the included angle $\theta$ is the angle defined by the principal flow axis of the free-falling molten titanium stream and the gas nozzles 52.

The interiors of gas nozzles 52 may be, in terms of cross section, of either a straight bore or converging-/diverging design. The interior diameters of gas nozzles 52 are generally selected to yield a combined gas mass flow rate for all the gas nozzles 52 sufficient to make the ratio of the gas mass flow rate to the molten metal mass flow rate in the range of from 1:1 to 6:1. It is preferred that the gas nozzles 52 are supplied by a common plenum (not shown) so that the gas supply pressure is substantially equal for each nozzle. The lengths of the individual gas nozzles 52 may vary from a fraction of an inch to several inches. While the lengths of gas nozzles 52 need not be the same, it is necessary to employ a symmetry that places nozzles having the same length in diametric opposition to each other so that skewing of the atomization plume is avoided. Alternatively, the individual gas nozzles 52 may merely be openings in ring 54 through which the inert gas jet can flow.

In a preferred embodiment, central opening 56 has a two inch inside diameter and eight to twelve gas nozzles 52 are equally spaced on ring 54 about central opening 56. Each nozzle 52 is inclined so as to define an included angle of 20 degrees and has a diameter of ninety-three one-thousandths of an inch. This nozzle configuration has been found to minimize metal buildup at the gas nozzles.

Figure 5:
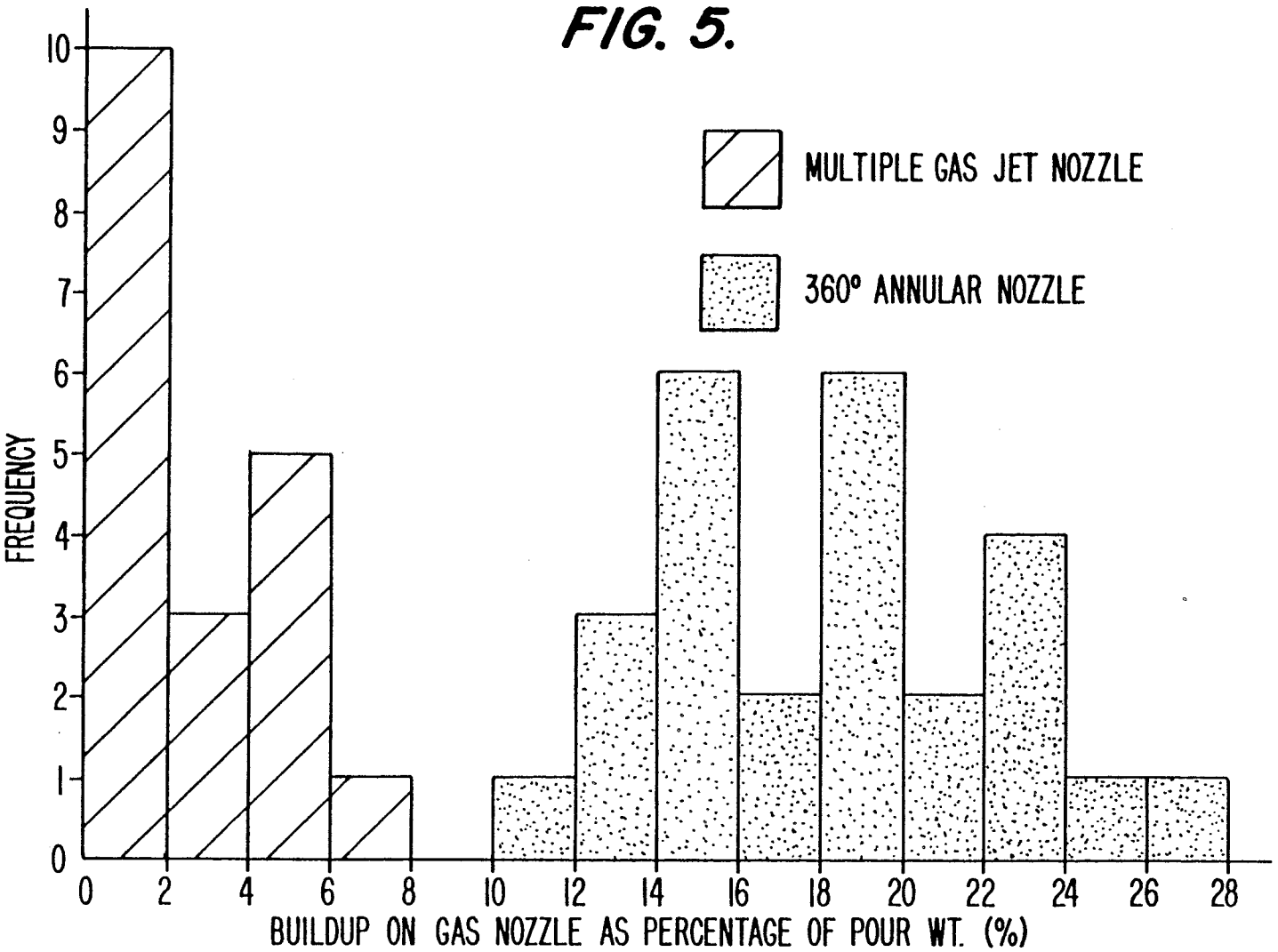
FIG. 5 is a graph of the metal buildup on the gas nozzle as a percentage of pour weight versus the frequency or number of occurrences for a 360 degree annular nozzle and a multiple gas jet nozzle of one embodiment of the system of the invention.

FIG. 5 is a graph of the metal buildup on the gas nozzle as a percentage of pour weight versus the frequency or number of occurrences for a 360 degree annular nozzle and a multiple gas jet nozzle having either eight or twelve discrete gas nozzles. As can be seen in FIG. 5, the metal buildup on the annular nozzle ranges from about 12% of the pour weight to over 20%. The metal buildup on the multiple gas jet nozzle is generally below 5% of the pour weight.

In accordance with the invention, the system includes means for cooling the atomized titanium. As embodied herein, and with reference to FIG. 1, the means for cooling the atomized titanium includes cooling tower 60 which receives the atomized titanium and means for introducing a primary cooling gas and a secondary cooling gas into cooling tower 60. In the atomization of highly reactive, low thermal conductivity metals such as titanium, sintering of the titanium powder in the cooling tower is often a problem because the heat absorption characteristics of argon are such that it cannot remove the heat from the atomized titanium rapidly enough to prevent such sintering. To solve the sintering problem, it has been proposed to use helium, which has superior heat absorption characteristics as compared to argon but is significantly more expensive, as the atomizing gas. Other approaches include increasing the quantity of gas used, providing a liquid gas quenchant, increasing the length of the cooling tower, and providing a fluidized bed. These solutions, however, may increase the cost of the atomization process and introduce certain operational problems. The inventors have found that the use of a primary cooling gas and a secondary cooling gas, where the primary cooling gas is argon and the secondary cooling gas is selected from the group consisting of helium and hydrogen, effectively prevents sintering of the atomized titanium without significantly increasing the cost of the atomization process.

The primary and secondary cooling gases may be introduced into the cooling tower in either of two ways. According to a first embodiment, the means for introducing the primary cooling gas and the secondary cooling gas into the cooling tower includes both the gas nozzle means and a source of blended primary and secondary cooling gases communicating with the gas nozzle means. As embodied herein, and with reference to FIG. 1, the gas introducing means includes gas nozzle means 50 in gas flow communication via conduit 59 with source 58. In this embodiment, source 58 may be filled with a blend of argon and either helium or hydrogen. Alternatively, according to a second embodiment, the gas introducing means may include both the gas nozzle means and a source of secondary cooling gas introduced directly into the cooling tower. As embodied herein, the injecting means includes gas nozzle means 50 in gas flow communication via conduit 59 with source 58 and inlet 62 in gas flow communication via conduit 63 with secondary cooling gas source 64. In this alternative embodiment, source 58 is filled with argon, the primary cooling gas, and source 64 is filled with helium or hydrogen.

The blend of primary and secondary cooling gases can be adjusted to meet the atomization and cooling requirements of the particular atomization process. The lowest gas costs for the process are achieved, however, when only the amount of secondary cooling gas required to avoid powder sintering is used.

Table I summarizes the results of trials conducted in the experimental scale atomization unit disclosed in U.S. Pat. No. 4,544,404, the disclosure of which is hereby incorporated by reference, using a blend of argon and helium as the atomization gas. In these trials, argon and helium were blended at 1000 psi and this blend was used to atomize a Ti—1Al—8V—5Fe alloy. A Ti—6Al—4V alloy was atomized using 100% argon and 100% helium as the atomizing gas for purposes of comparison.

TABLE I

| Alloy | Atomization Gas Vol. % Ar | Atomization Gas Vol. % He | Atomization Gas Wt. % Ar | Atomization Gas Wt. % He | Yield of Unsintered-35 Mesh Powder (%) | Relative Gas Cost |
|---|---|---|---|---|---|---|
| Ti—6Al—4V | 100 | 0 | 100 | 0 | 32 | 0.37 |
| Ti—1Al—8V—5Fe | 75 | 25 | 97 | 3 | 100 | 0.53 |
| Ti—1Al—8V—5Fe | 50 | 50 | 91 | 9 | 100 | 0.69 |
| Ti—1Al—8V—5Fe | 25 | 75 | 77 | 23 | 100 | 0.84 |
| Ti—6Al—4V | 0 | 100 | 0 | 100 | 100 | 1.00 |

As can be seen in Table I, incorporating as little as 3 weight percent of the secondary cooling gas helium in the argon atomization gas is sufficient to prevent sintering of the titanium alloy powder. It is believed that as little as at least approximately 1 weight % of the secondary cooling gas will be sufficient to prevent sintering in certain atomization situations. The yield of −35 mesh powder is intended to provide an indication of the degree of powder sintering and does not necessarily reflect the atomization efficiency of the gas blends.

Table II summarizes the results of trials conducted in the larger scale atomization unit disclosed herein using 100% argon as the atomization and primary cooling gas and introducing the secondary cooling gas helium into the cooling tower as relatively low pressure gas. In these trials, the nominal gas pressure of the argon atomization gas was 800 psi and the nominal pressure of the helium gas being introduced into the cooling tower was 200 psi. The flow rate of the helium was adjusted so that the gas mixture in the cooling tower during atomization contained 21 volume % helium.

TABLE II

| Atomization Alloy | Gas | Helium Gas Injected Into Atomization Chamber as Percentage of Atomization Gas by vol. % (by wt. %) | Yield of Unsintered-35 Mesh Powder (%) | Relative Gas Cost |
|---|---|---|---|---|
| Ti—6Al—4V | 100% Ar | 0 | 30 | 0.37 |
| Ti—14Al—20Nb—3.2V—2Mo | 100% Ar | 21 (2.7) | 100 | 0.58 |
| — | 100% He | — | — | 1.00 |

As can be seen in Table II, the introduction of just 2.7 weight percent of the secondary cooling gas helium into the cooling tower is sufficient to prevent sintering of the titanium alloy powder. Again, it is believed that as little as at least approximately 1 weight % of the secondary cooling gas will be sufficient to prevent sintering in certain atomization situations. Introducing helium into the cooling tower is generally preferred over incorporating helium in the blend of atomization gas because more of the supply of pressurized helium can be utilized when it is introduced at low pressure.

After the free-falling stream of molten titanium is impinged with the inert gas jet, the atomized droplets of titanium cool and solidify during their flight through the cooling tower. Several aspects of the construction of the cooling tower are important. First, the cooling tower must be large enough to allow the droplets to solidify before they come in contact with the walls or bottom section of the cooling tower. In addition, the cooling tower must be constructed of a material that is acceptable for contact with titanium powder. Stainless steel is the preferred material for the cooling tower. Also, the cooling tower should be constructed so that it can be evacuated to a vacuum of 0.5 torr or less without significant vacuum leaks. It is helpful if the cooling tower is designed to allow for easy and complete cleaning and inspection of its interior. As embodied herein, cooling tower 60 includes upper portion 66 and lower portion 68. The lower portion 68 is generally cone-shaped and can be removed from upper portion 66 to facilitate the cleaning and inspection of cooling tower 60.

In accordance with the invention, the system includes means for collecting the cooled atomized titanium. As embodied herein, and with reference to FIG. 1, the means for collecting the cooled atomized titanium includes powder separation cyclone 70 and powder collection canister 80. Transfer line 72 connects the lower portion 68 of cooling tower 60 with powder separation cyclone 70. The cooled atomized titanium particles are carried by the exhaust gases from cooling tower 60 to cyclone 70 through transfer line 72. The high rate of gas flow in transfer line 72 entrains the cooled atomized titanium particles and carries the particles into cyclone 70. The separated particles are collected in canister 80 disposed below cyclone 70. The gases used in the process are exhausted from cyclone 70 via gas exhaust line 90.

The principles of the system for atomizing titanium described broadly above will now be described with reference to specific examples.

EXAMPLE I

A fifty-pound charge of Ti—14.1 Al—19.5 Nb—3.2 V—2 Mo alloy was induction melted in a water-cooled, segmented copper crucible disposed in a furnace chamber having an atmosphere of argon. The molten titanium alloy was lip poured into an induction heated, two-piece graphite tundish having a commercially pure titanium liner disposed on the inner surface of the upper, frustoconical portion of the tundish. A commercially pure titanium baffle comprised of two intersecting plates was disposed in the tundish to stabilize the molten alloy. The tundish was induction heated to a temperature of approximately 1800° F.

The molten titanium alloy exited the tundish through a refractory metal nozzle comprised of tantalum disposed in an aperture in the bottom, circular portion of the tundish. The molten titanium alloy was formed into a free-falling stream as it flowed through the tantalum nozzle. As the free-falling stream passed through the gas nozzle, it was impinged with argon atomizing gas at an atomizing pressure of about 800 psi. The atomized titanium alloy particles cooled and solidified in a stainless steel cooling tower having a height of about 160 inches and a diameter of about 60 inches. The atmosphere in the cooling tower was comprised of 95–97 wt. % argon and 3–5 wt. % helium. The cooled atomized titanium alloy particles were passed through a cyclone and collected in a canister disposed below the cyclone. The weight of the titanium alloy powder produced was approximately 18 pounds and there was no significant sintering of the powder.

EXAMPLE II

A forty-pound charge of Ti—32 Al—1.3 V alloy was atomized in the manner described above with respect to Example I. The weight of the titanium alloy produced was approximately 13.5 pounds and there was no significant sintering of the powder.

It is understood that the term "titanium-based material" as used herein includes titanium and titanium-based alloys and, in particular, titanium aluminides.

The present invention has been disclosed in terms of preferred embodiments. The invention is not limited thereto and is defined by the appended claims and their equivalents.

What is claimed is:

1. A system for atomizing a titanium-based material to particulates in a controlled atmosphere, said system comprising:

crucible means for induction skull melting a titanium-based material;

tundish means for receiving a molten titanium-based material, said tundish means having a bottom portion with an aperture formed therein;

means for heating said tundish means;

molten metal nozzle means for forming the molten titanium-based material into a free-falling stream exiting from said tundish means, said molten metal nozzle means being coaxially aligned with said aperture of said tundish means;

gas nozzle means for impinging said free-falling stream of the molten titanium-based material with an inert gas jet to atomize the molten titanium-based material to particulates;

means for cooling the atomized titanium-based material; and means for collecting the cooled atomized titanium-based material.

2. The system for atomizing a titanium-based material according to claim 1, further including baffle means disposed in said tundish means for stabilizing said free-falling stream of molten titanium-based material.

3. The system for atomizing a titanium-based material according to claim 1, wherein the means for cooling the atomized titanium includes a cooling tower for receiving the atomized titanium and means for introducing a primary cooling gas and a secondary cooling gas into the cooling tower.

4. The system for atomizing a titanium-based material according to claim 3, wherein the means for introducing the primary cooling gas and the secondary cooling gas includes both said gas nozzle means and a source of blended primary and secondary cooling gases communicating with said gas nozzle means.

5. The system for atomizing a titanium-based material according to claim 3, wherein the means for introducing the primary cooling gas and the secondary cooling gas includes both said gas nozzle means and a source of secondary cooling gas introduced directly into said cooling tower.

6. The system for atomizing a titanium-based material according to claim 1, wherein said bottom portion of said tundish comprises a removable graphite plate, said aperture of said tundish being formed in said plate.

7. The system for atomizing a titanium-based material according to claim 6, wherein said aperture is generally circular.

8. The system for atomizing a titanium-based material according to claim 7, wherein said molten metal nozzle means includes a refractory metal nozzle, said nozzle having a cylindrical configuration with an inside diameter substantially equal to the inside diameter of said circular aperture.

9. The system for atomizing a titanium-based material according to claim 8, wherein said refractory metal nozzle is comprised of a refractory metal selected from the group consisting of tantalum, molybdenum, tungsten, rhenium, and alloys thereof.

10. The system for atomizing a titanium-based material according to claim 1, wherein said tundish means further includes a top portion and a removable liner disposed about an inner surface of said top portion.

11. The system for atomizing a titanium-based material according to claim 10, wherein said top portion of said tundish means has a frustoconical configuration.

12. The system for atomizing a titanium-based material according to claim 2, wherein said baffle means comprises a baffle having at least two intersecting plates, said plates being dimensioned such that the outer ends thereof abut an inner surface of said removable liner to hold the baffle above the bottom portion of said tundish means.

13. The system for atomizing a titanium-based material according to claim 10, wherein said removable liner consist essentially of commercially pure titanium.

14. The system for atomizing a titanium-based material according to claim 12, wherein said intersecting plates consist essentially of commercially pure titanium.

15. The system for atomizing a titanium-based material according to claim 1, wherein said gas nozzle means includes a plurality of discrete gas nozzles disposed on an annular ring about a central opening.

16. The system for atomizing a titanium-based material according to claim 15, wherein said nozzles are each inclined so as to define an included angle between 0 and 45 degrees.

17. The system for atomizing a titanium-based material according to claim 15, wherein eight to twelve gas nozzles are equally spaced on said ring about said opening, said nozzles each being inclined so as to define an included angle of approximately 20 degrees.

18. A system for atomizing a titanium-based material to particulates in a controlled atmosphere, said system comprising:

crucible means for induction skull melting a titanium-based material;

tundish means for receiving a molten titanium-based material, said tundish means having a bottom portion with an aperture formed therein and having baffle means disposed in said tundish means for stabilizing a free-falling stream of molten titanium-based material exiting from said tundish means;

means for heating said tundish means;

molten metal nozzle means for forming the titanium-based material into said free-falling stream, said molten metal nozzle means being coaxially aligned with said aperture of said tundish means;

gas nozzle means for impinging said free-falling stream of the molten titanium-based material with an inert gas jet to atomize the molten titanium-based material to particulates;

means for cooling the atomized titanium-based material; and means for collecting the cooled atomized titanium-based material.

19. The system for atomizing a titanium-based material according to claim 18, wherein the means for cooling the atomized titanium includes a cooling tower for receiving the atomized titanium and means for introducing a primary cooling gas and a secondary cooling gas into the cooling tower.

20. The system for atomizing a titanium-based material according to claim 19, wherein the means for introducing the primary cooing gas and the secondary cooling gas includes both said gas nozzle means and a source of blended primary and secondary cooling gases communicating with said gas nozzle means.

21. The system for atomizing a titanium-based material according to claim 19, wherein the means for introducing the primary cooling gas and the secondary cooling gas includes both said gas nozzle means and a source of secondary cooling gas introduced directly into said cooling tower.

22. The system for atomizing a titanium-based material according to claim 18, wherein said bottom portion of said tundish comprises a removable graphite plate, said aperture of said tundish being formed in said plate

23. The system for atomizing a titanium-based material according to claim 22, wherein said aperture is generally circular.

24. The system for atomizing a titanium-based material according to claim 23, wherein said molten metal nozzle means includes a refractory metal nozzle, said nozzle having a cylindrical configuration with an inside diameter substantially equal to the inside diameter of said circular aperture.

25. The system for atomizing a titanium-based material according to claim 24, wherein said refractory metal nozzle is comprised of a refractory metal selected from the group consisting of titanium, molybdenum, tungsten, rhenium, and alloys thereof.

26. The system for atomizing a titanium-based material according to claim 18, wherein said tundish means further includes a top portion and a removable liner disposed about an inner surface of said top portion.

27. The system for atomizing a titanium-based material according to claim 26, wherein said top portion of said tundish means has a frustoconical configuration.

28. The system for atomizing a titanium-based material according to claim 18, wherein said baffle means comprises a baffle having at least two intersecting plates, said plates being dimensioned such that the outer ends thereof abut an inner surface of said removable liner to hold the baffle above the bottom portion of said tundish means.

29. The system for atomizing a titanium-based material according to claim 26, wherein said removable liner consist essentially of commercially pure titanium.

30. The system for atomizing a titanium-based material according to claim 28, wherein said intersecting plates consist essentially of commercially pure titanium.

31. The system for atomizing a titanium-based material according to claim 18, wherein said gas nozzle means includes a plurality of discrete gas nozzles disposed on an annular ring about a central opening.

32. The system for atomizing a titanium-based material according to claim 31, wherein said nozzles are each inclined so as to define an included angle between 0 and 45 degrees.

33. The system for atomizing a titanium-based material according to claim 31, wherein eight to twelve gas nozzles are equally spaced on said ring about said opening, said nozzles each being inclined so as to define an included angle of approximately 20 degrees.

* * * * *